United States Patent [19]

Derudder

[11] Patent Number: 4,858,654

[45] Date of Patent: Aug. 22, 1989

[54] PULLEY-BLOCK DRIVE OPEN SHED JACQUARD MACHINE

[75] Inventor: Carlos Derudder, Kortrijk-Heule, Belgium

[73] Assignee: N. V. Michel Van De Wiele, Belgium

[21] Appl. No.: 153,098

[22] Filed: Feb. 8, 1988

[30] Foreign Application Priority Data

Feb. 13, 1987 [BE] Belgium ..... 8700128

[51] Int. Cl.[4] ..... D03C 13/00; D03C 3/00; D03C 3/06

[52] U.S. Cl. ..... 139/59; 139/63; 139/455; 139/456

[58] Field of Search ..... 139/63, 72, 59, 65, 139/455, 46

[56] References Cited

U.S. PATENT DOCUMENTS

| | | | |
|---|---|---|---|
| 3,669,154 | 6/1972 | Horak | 139/63 |
| 4,060,101 | 11/1977 | Seiler | 139/59 X |
| 4,469,140 | 9/1984 | Seiler | 139/59 |

FOREIGN PATENT DOCUMENTS

| | | | |
|---|---|---|---|
| 0055199 | 6/1982 | European Pat. Off. | 139/65 |
| 51-60761 | 5/1976 | Japan | 139/63 |
| 0163440 | 9/1984 | Japan | 139/59 |
| 141592 | 4/1920 | United Kingdom | 139/65 |

*Primary Examiner*—Andrew M. Falik
*Attorney, Agent, or Firm*—James Creighton Wray

[57] ABSTRACT

A pulley-block drive of an open shed Jacquard mechanism is sectionally controlled by a movable suspension apparatus. Pulley bands or harness cords are attached to one of the ends of the movable suspension apparatus. The movable suspension apparatus is suspended from hooks which can engage with the knives of the jacquard machine so that the movable suspension apparatus is driven by the knife grid of the jacquard mechanism.

13 Claims, 6 Drawing Sheets

PULLEY-BLOCK DRIVE OPEN SHED JACQUARD MACHINE

BACKGROUND OF THE INVENTION

Jacquard machines are used to weave patterns in pile fabrics. In face-to-face weaving, there are in fact two ground fabrics: the upper or top fabric and the under or bottom fabric, which have their pile sides turned to each other and, during the weaving, are connected by a pile warp end. The pile warp end can take three positions during weaving, respectively, above the upper ply, in the middle between the two fabrics, or under the lower ply. It is the jacquard machine which puts each pile warp end in one of these positions before each pick.

Belgian Patent No. 894.283 describes then pulley-block drive open shed jacquard machine in which one end of the pulley band terminates at a hook of the jacquard machine and the other terminates at a movable suspension apparatus, while the harness pulley bands are respectively fixed at one end to the harness band and at the other at a fixed suspension apparatus.

The movable suspension apparatus is made up of one or more movable boards to which the end of one or more pulley bands are affixed so that they terminate sectionally and can be controlled in accordance with a particular program.

Such a pulley-block drive assumes the advantages of an open shed jacquard machine with pulley-blocks, avoids the disadvantage that there must be two hooks for each programmable point, and combines a maximum of possible patterns with a minimum floorspace.

Where the boards in the said Belgian patent are driven by a cam through a lever mechanism and therefore a separate drive is required, it is the goal of the present invention to eliminate this supplementary drive.

SUMMARY OF THE INVENTION

The jacquard machine according to this invention, in which one end of the pulley bands is attached to one hook of the jacquard machine and the other at a movable suspension apparatus, is distinguished in that the movable suspension apparatus is driven by the knife grids of the jacquard machine. In a special design-execution of the jacquard machine according to this invention, the movable suspension apparatuses are each suspended from a number of hooks which can hook on the jacquard machine's knife grid and which are each provided with a control needle to effectuate that movement.

In the preferred design-execution of the jacquard machine according to this invention, each hook that carries part of the movable suspension apparatus consists of two flat steel or plastic strips placed next to each other and which are provided at the appropriate height with a hook-shaped projection which can catch the knife grid.

With reference to the jacquard machine described in Belgian Patent No. 894.283, the jacquard machine of this invention has the advantages that the supplementary drive for each movable board is avoided, that the synchronization between the movements of the jacquard machine's hooks and those of the boards is easier to obtain, and that the movements of the boards may be more easily and extensively programmed.

More unusual features and advantages will become apparent from the following description, noted solely as an example without any limiting nature, of a preferred design-execution of a jacquard machine in accordance with the invention. The description refers to the figures hereby attached.

BRIEF DESCRIPTION OF THE DRAWINGS

FIG. 4*a* shows a standard preselection driving device and a Jacquard slide.

DETAILED DESCRIPTION OF THE DRAWINGS

Figure 1:
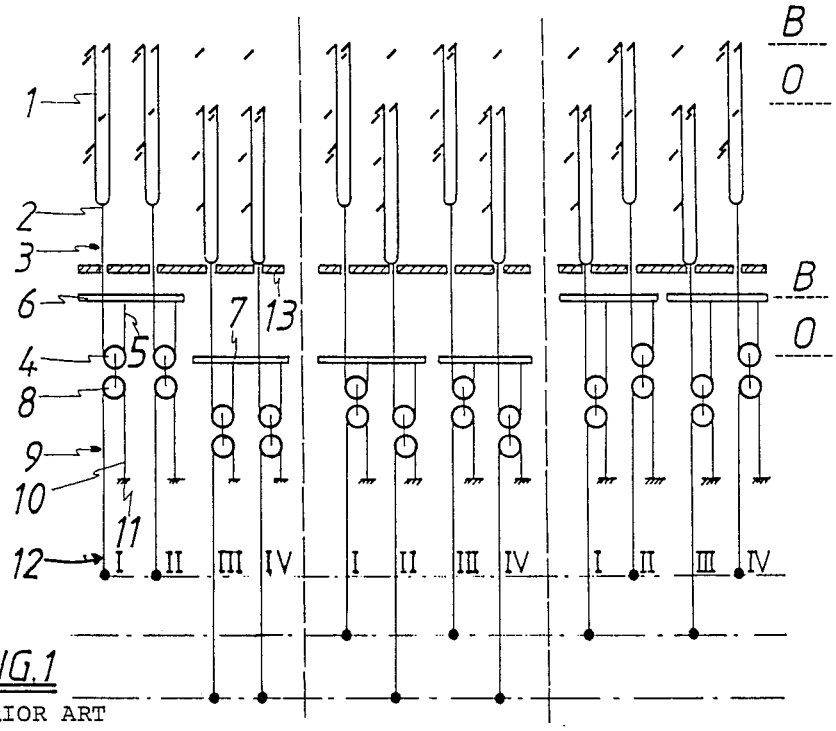
FIG. 1 PRIOR ART
FIG. 1 is a schematic rendering of the operation of a prior art jacquard machine with sectionally controlled pulley-block drives with a 3 pick V-binding structure working according to Belgian Patent No. 894.283.

For a clear understanding of the operation of the jacquard machine according to this invention, the principle of a jacquard machine with sectionally-controlled pulley-block drives is briefly described based on FIG. 1. In such a jacquard machine, a hook 1 carries one end 2 of a pulley band 3 which passes around a pulley 4. The other end 5 of the pulley band 3 is fixed, for example, to the movable suspension apparatus, preferably a board 6 or 7. Each board 6 or 7 supports the end 5 of a number of pulley bands 3. There is for each pulley 4 another pulley 8. Passing around pulley 8 is harness band 9, the one end of which 10 is attached to the fixed suspension apparatus 11, and the lower end 12 of which is attached to the harness (not depicted). To place pile warp ends (I, II, III, IV) in their three possible positions, it is sufficient to place the hooks 1 either under 0 or above B in combination with the boards 6 or 7 under 0 or above B, as shown in FIG. 1.

From FIG. 1, it therefore is apparent that the boards 6 or 7 must be able to perform four possible combinations: aboveabove, above-under, under-under, under-above. The jacquard machine's bottom board 13 is also indicated in FIG. 1.

In the jacquard machine according to the invention, FIGS. 2 and 4*a–d*, the combinations of the movable suspension apparatus, in this case the boards 6 or 7, are driven by the jacquard machine's knife grid.

Figure 2:
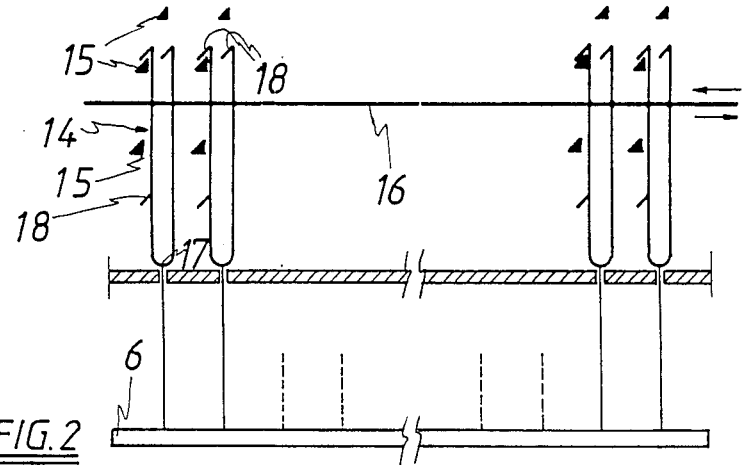
FIG. 2 PRIOR ART
FIG. 2 is a schematic rendering of a first design-execution of the distinguishing portion of the jacquard machine according to this invention.

A first design-execution of the jacquard machine according to the invention is described by FIG. 2. A board 6 is suspended from a number of classical jacquard machine hooks 14. The hooks 14 are distributed in rows parallel to the sides of the board 6 into and depthwise oriented in the jacquard head. These hooks can be picked up by the knives 15 of the jacquard machine's knife grid. To that end, all rows of hooks 14 of one board, each placed within or out of reach of the knives 15 by the moving together of needles 16 by means of a horizontal movement of the needles 16. Just as the hooks 1 of pulley bands 3 in FIG. 1, the hooks 14 of the boards can also undergo the four combinations between both required positions, above and under, by the joint action with the knives of the knife grids.

In certain circumstances, the classical jacquard machine hooks, however, will have too little strength. Given that the attachment point 17 of a part of the weight, and the load on the board 6 is not located under the hooks 18 of the hooks 14, in the case of a heavy load, the hook deflects under the action of the bending movement occurring in the hook, so that the hooks 18 no longer lie in the path of the knives 15 and the good operation of the jacquard machine is endangered.

Figure 3:
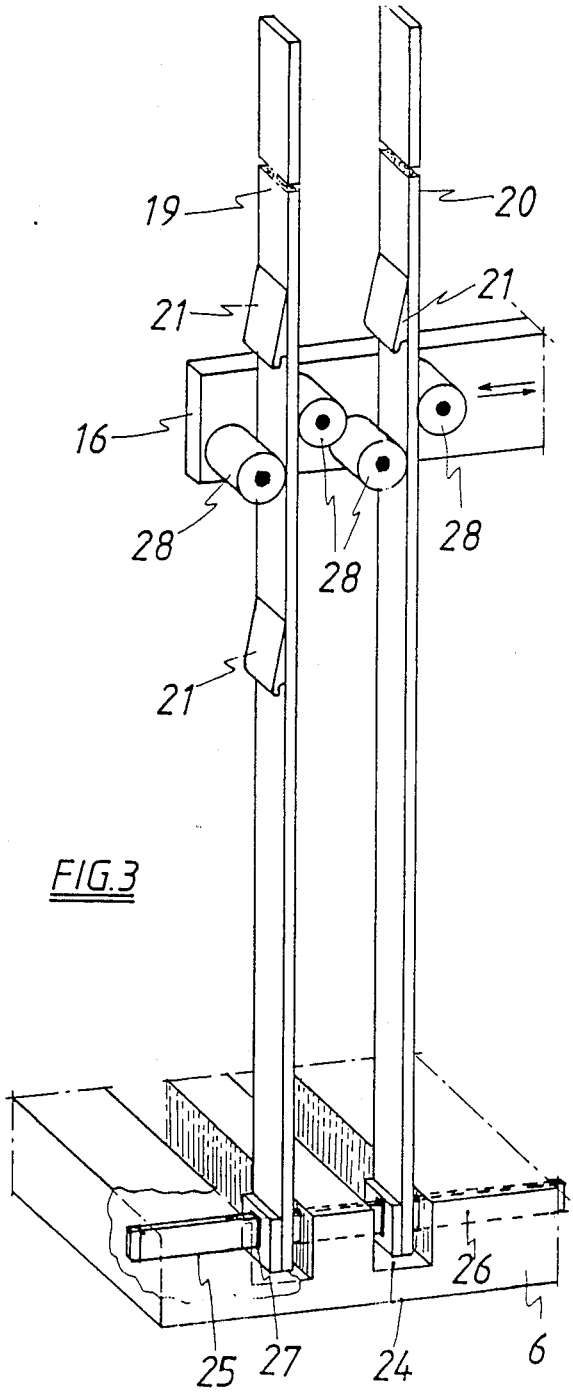
FIG. 3 is a perspective view of a portion of the needle and both flat steel or plastic strips which together form a hook for a second design-execution of the jacquard machine according to this invention.
Figure 4A:
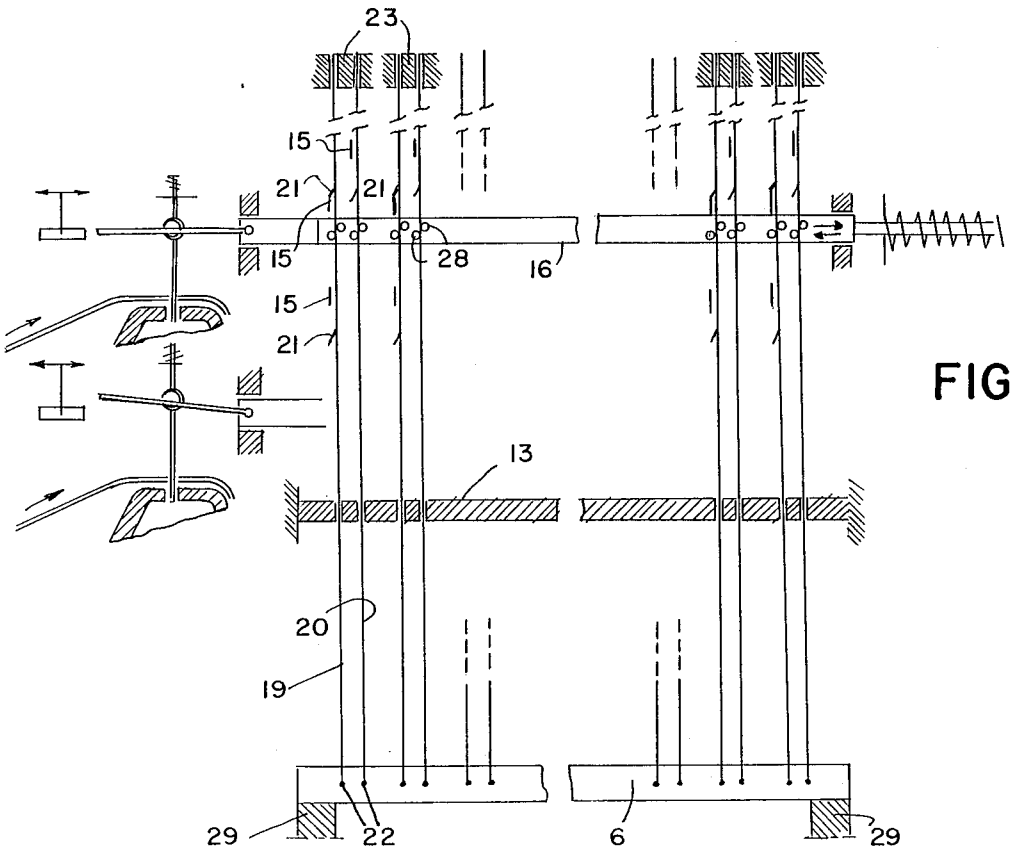
FIGS. 4*a, b, c* and *d* are schematic rendering of a second design-execution of the distinguishing portion of the jacquard machine according to this invention specifically.
Figure 4B:
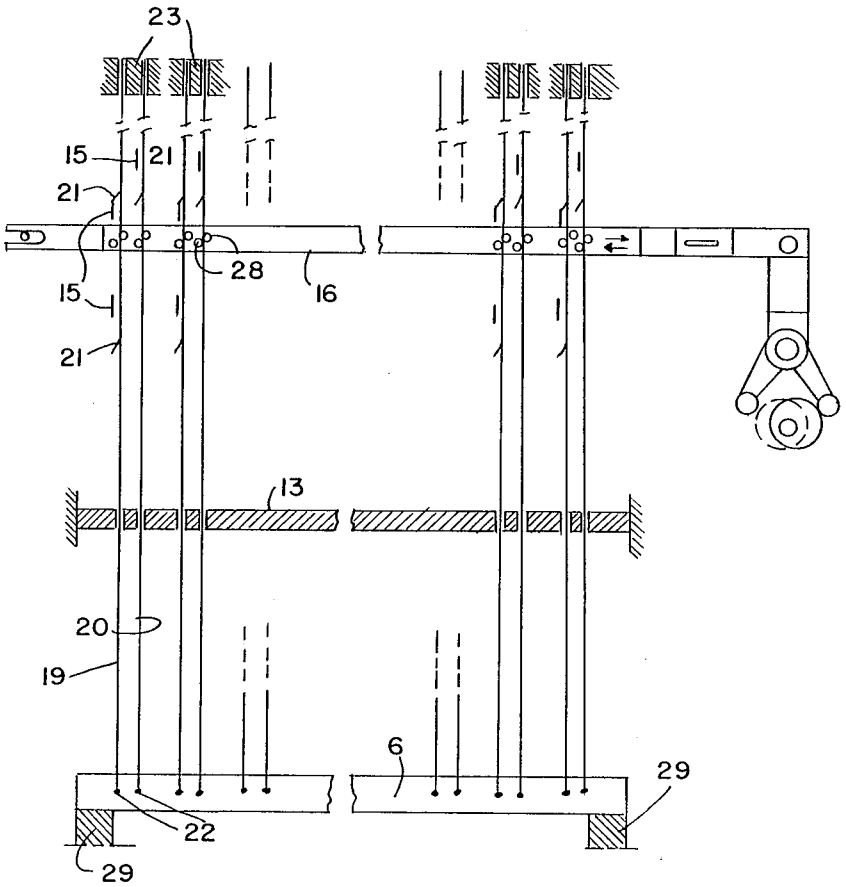
FIGS. 4*b* shows a preselection driving system comprising a standard cam and follower transmission.
Figure 4C:
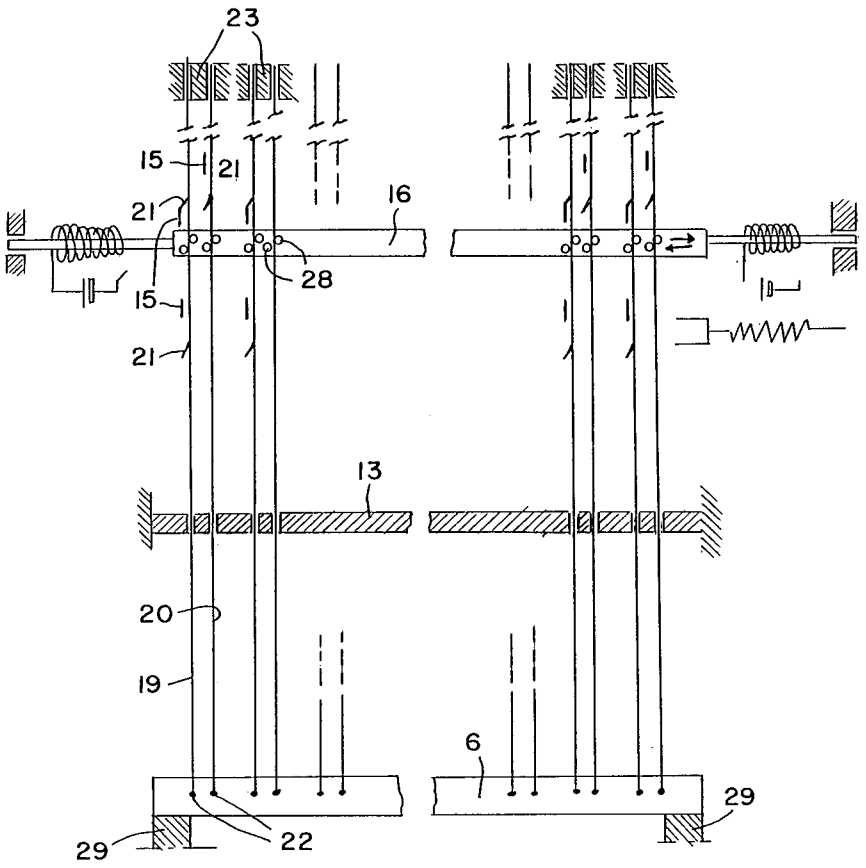
FIG. 4*c* shows a preselection driving system comprising a standard electronic positioning means.
Figure 4D:
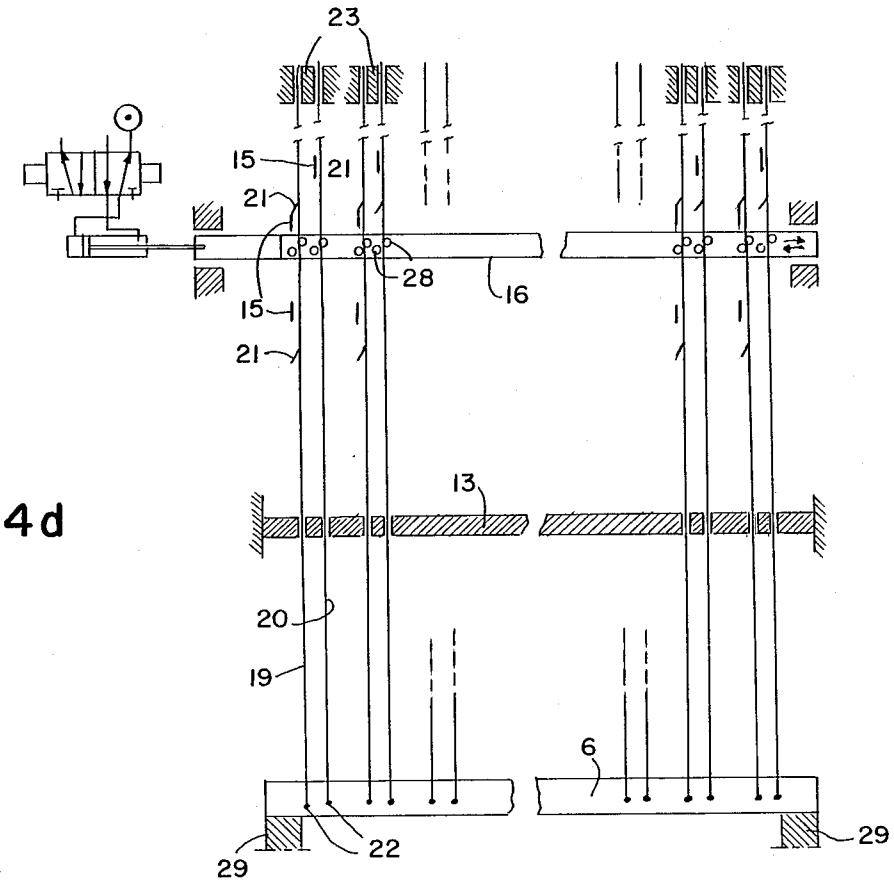
FIG. 4*d* shows a preselection driving system comprising a standard pressure means.
Figure 5A:
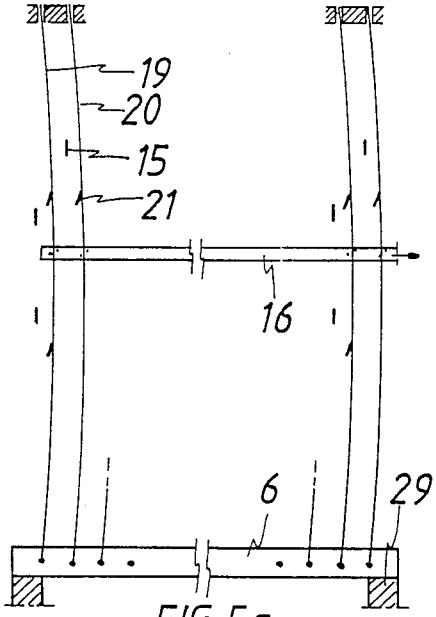
FIGS. 5*a, b, c* and *d* are schematic renderings of the four possible combinations using both positions of a board of a jacquard machine according to the invention.
Figure 5B:
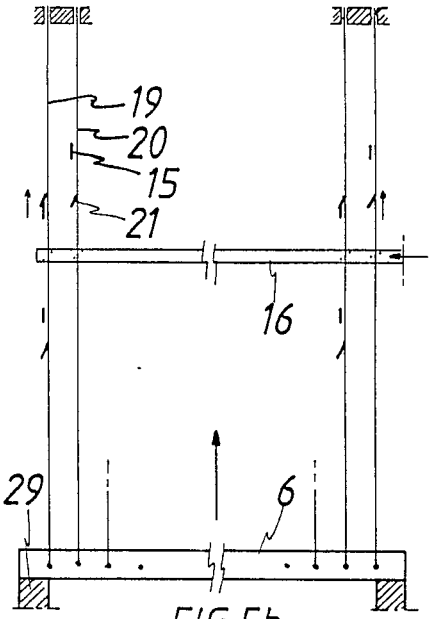
Figure 5C:
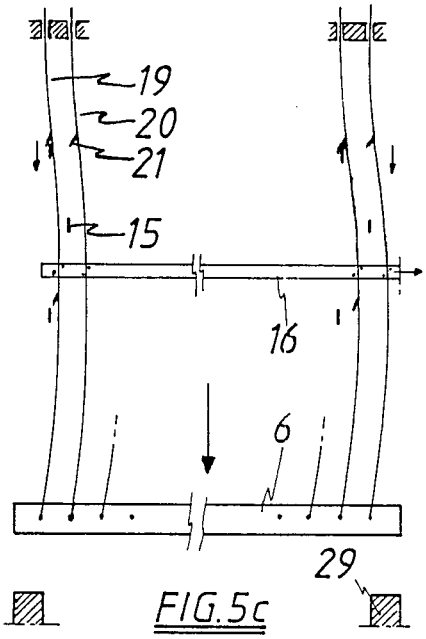
Figure 5D:
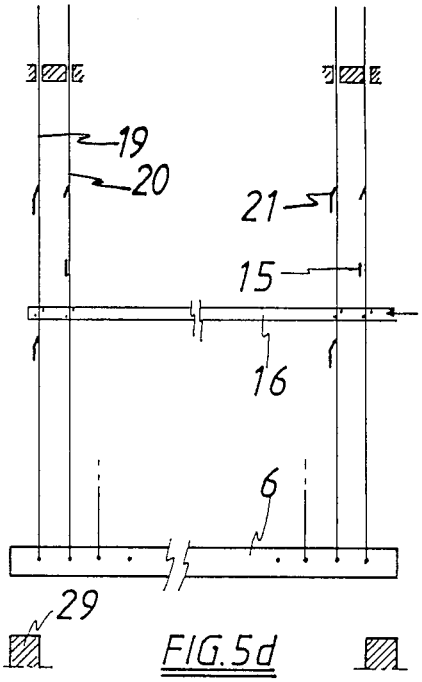

To correct this problem, a new hook was developed, which consists of two flat steel or plastic strips 19 and 20, FIG. 3. Each classical hook 14, FIG. 2, is thus replaced by a pair of strips 19 and 20 which are provided at the appropriate height with hook-shaped projections 21, which then conform with the hooks 18 of the classical hook 14, FIG. 2. The strips 19 and 20 are so arranged in the jacquard machine that the control needle 18 must overcome their bend resistance, or therefore, in such a way that the smallest dimension of their section is placed parallel to the movement of the needle 16. The section of the strips 19 and 20 is therefore such that they are large enough to absorb the load and that they have the desired small bend resistance in one direction.

The strips 19 and 20 are therefore pivotably attached at their bottoms, two by two along the sides of the board 6, over the width of the board 6 in depth direction of the jacquard board, FIGS. 4 4*a–d*. The pivot joint may consist of a short small shaft 22 attached to the board 6 and around which the ring-shaped end of a strip 19 and 20 is pivotably attached. The strips 19 and 20 pass freely through the bottom board 13 from bottom to top. The strips 19 or 20 move upward in a fixed guide 23 which permits some deflecting of the strips 19 and 20. For that purpose, the top end of the strips 19 and 20 is or may be mounted in a small guide block with some clearance. Also the pivot attachment at the bottom end can be made to allow for clearance. A preferred design-execution of this connection is given in FIG. 3. There is a groove 24 at each point where the strips 19 or 20 are joined to the board 6. Along the width of the board 6 and passing through the grooves 24, there are one or two openings 25 provided through which a long rod 26 is passed. The lower ends of the strips 19 and 20 are also provided with one or two openings 27, the section of which, however, is larger than that of the rod 26. In this manner, the strips 19 and 20 can be easily connected with the board 6 or be replaced. It is sufficient to slide the rod 26 in or out and thereby pass it through the openings 27. Through the difference in dimensions, there is a certain clearance in this connection. This is necessary since the board 6 sometimes also undergoes a slightly inclined movement during its vertical movement, the so-called progressive shed movement.

The needle 16, FIG. 3, also has an adapted form in this second design-execution. The needle 16 is provided, at the sides of each strip 19 or 20, with two small rollers 28 which make contact along the strips 19 or 20 between the hook-shaped projections 21. All needles 16 of one board 6 undergo the same movement. This movement can be obtained by means of a cam mechanism, by one or more pressure cylinders, or by a preselection apparatus controlled by the jacquard cards.

This last solution is simple to synchronize with the movement of the normal hooks which lift up the pulley bands and is easy to program with the jacquard cards.

In the first design-execution, FIG. 2, the board 6 hangs in its lowest position on the hooks 14, which are supported on the upper surface of the bottom board 13, just as occurred with the hooks 1 on which the pulley bands 3, FIG. 1, hang. Given that the strips 19 and 20 freely move through the bottom board 13, in the second design-execution, there ought to be lower supports 29, FIGS. 4 4*a–d*, provided for the board 6, so that it rests on the lower supports 29 in its lowest position.

FIG. 5 provides a schematic view of how the four possible combinations between both positions of the board 6 are made possible in the second design-execution. The needle 16 takes two positions: a first position in which the strips 19 or 20 are laterally deflected, FIGS. 5*a* and *c*, and a second position in which the strips 19 or 20 are not deflected, FIGS. 5*b* and *d*. If the strips 19 or 20 are deflected, the knives 15 cannot engage in the hook-shaped projections 21 and the board 6 remains resting upon the lower supports 29, FIG. 5*a*, or the free knives 15 cannot engage in the hook-shaped projections 21 and the knives 15 that have already engaged in the projections support the strips 19 or 20 or the board 6 so that the board, for example, can fall, FIG. 5*c*. If the strips 19 and 20 are not deflected, some knives 15 can bring board 6 from bottom to top position, FIG. 5*b*, or the fixed knives 15 can take over the board 6 so that the board 6 remains in the upper position, FIG. 5*d*.

What is claimed is:

1. Jacquard loom machine apparatus comprising movable suspension apparatus and moving means for moving the suspension apparatus by knife grids of the jacquard machine apparatus, the moving means comprising hook means and connecting means for connecting the hook means to the movable suspension apparatus, hook-shaped projection means on the hook means and lateral moving means for moving the hook means laterally for selectively engaging and disengaging the hook-shaped projections with the knife grids;

wherein the hook means comprise flat strips aligned next to each other and wherein the hook-shaped projections are provided on flat sides of the flat strips;

wherein further the lateral moving means comprise needle means having their first and second opposite rollers contacting opposite flat faces of each strip, the rollers being connected to the needle means for moving horizontally with the needle means, whereby portions of the strips are moved laterally with the needle means and the rollers for selectively engaging and disengaging the hook-shaped projections with the knife grids.

2. The apparatus of claim 1 wherein the movable suspension means comprise boards attached to the strips at bottoms of the strips and wherein the boards are attached to the strips with pivotably connections.

3. The apparatus of claim 2 wherein the pivotable connections comprise ring shaped lower ends of the strips and shafts connected through the ring shaped lower ends of the strips and mounted in the boards.

4. The apparatus of claim 2 wherein the pivotable connections comprise grooves in the boards into which the bottoms of the strips extend and rods extending transversely through the grooves and through openings larger than the rods in the bottoms of the strips.

5. Jacquard loom apparatus comprising:

movable horizontal support boards;

vertical movable hooks and means for connecting the hooks and the support boards, each of the hooks having hook-shaped projections extending laterally from the hooks; and horizontally movable needles and means for connecting the needles which the hooks for moving the hook-shaped projections selectively into and out of engagement with knife grids;

wherein the hook means comprise flat strips having relatively wide dimensions transverse to a direction of needle movement and relatively narrow dimensions parallel to the direction of needle movement and wherein the means for connecting the needles to the strips comprise rollers connected to the needles and positioned on opposite sides of the strips for rolling along flat faces of the strips and for moving the strips horizontally with movement of the needle, while permitting flexing of the strips.

6. The apparatus of claim 5 wherein the means for connecting the boards comprise slots in upper surfaces of the boards extending in directions transverse to needle movement and rods connected to the boards and extending transversely through the slots parallel to the needles and openings in lower ends of the strips having dimensions larger than the rods, the openings receiving the rods for permitting pivoting actions between the strips and the boards.

7. An open shed jacquard machine comprising:

a plurality of pulley bands, hooks, knives, harness cords, and a movable suspension apparatus and a fixed suspension apparatus;

wherein one end of each pulley band is connected to one hook and the other end of each pulley band is connected to a movable suspension apparatus, while one end of each harness cord is connected to a harness and the other end of the harness cord is connected to a fixed suspension apparatus, so that all pulleyblocks can be sectionally controlled, and each movable suspension apparatus is driven by a knife grid of the jacquard machine;

wherein further each movable suspension apparatus is suspended from a number of hooks which can engage with the knives, each hook having the same form as the hooks to which the pulley bands are affixed and each hook consisting of two strips aligned next to one another each of which are provided at the appropriate height with a hook-shaped projection and each strip being pivotally attached at its base with the movable suspension apparatus and slides at its top in a guide, which permits a certain deflection of an upper end of the strip.

8. Open shed jacquard machine according to claim 7 characterized in that each strip is provided at its lower end with one or more openings and is fixed in a groove in the movable suspension apparatus by one or more rods, the dimension of which is smaller than that of the openings in the strips and which are slid transversely through the groove and through the openings in the strips.

9. Open shed jacquard machine according to claim 7 characterized in that all hooks of each movable suspension apparatus, by means of a series of commonly moving control needles, are placed in or out of engagement with the knife or the jacquard head.

10. Open shead jacquard machine according to claim 9 characterized in that the control needles are driven by means of a preselection apparatus from cards of the jacquard machine.

11. Open shed jacquard machine according to claim 9 characterized in that the control needles are driven by a cam and through a cam-follower and transmission.

12. Open shed jacquard machine according to claim 9 characterized in that the control needles are driven by means of one or more pressure cylinders.

13. Open shed jacquard machine according to claim 9 characterized in that the control needles are driven by means of one or more electronic positioning means.

* * * * *